US006899791B2

(12) United States Patent
Sabourin

(10) Patent No.: US 6,899,791 B2
(45) Date of Patent: May 31, 2005

(54) METHOD OF PRETREATING LIGNOCELLULOSE FIBER-CONTAINING MATERIAL IN A PULP REFINING PROCESS

(75) Inventor: Marc J. Sabourin, Huber Heights, OH (US)

(73) Assignee: Andritz Inc., Muncy, PA (US)

( * ) Notice: Subject to any disclaimer, the term of this patent is extended or adjusted under 35 U.S.C. 154(b) by 0 days.

(21) Appl. No.: 08/907,687

(22) Filed: Aug. 8, 1997

(65) Prior Publication Data

US 2001/0050151 A1 Dec. 13, 2001

(51) Int. Cl.[7] ..... D21B 1/14
(52) U.S. Cl. ..... 162/23; 162/28; 162/68
(58) Field of Search ..... 162/24, 23, 83, 162/25, 26, 68, 63, 29

(56) References Cited

U.S. PATENT DOCUMENTS

| | | | | |
|---|---|---|---|---|
| 2,145,851 A | | 2/1939 | Asplund | 92/6 |
| 2,323,194 A | | 6/1943 | Beveridge et al. | 92/6 |
| 2,396,587 A | | 3/1946 | Lowgren et al. | 92/7 |
| 2,422,522 A | | 6/1947 | Beveridge et al. | 92/6 |
| 2,904,460 A | | 9/1959 | Nolan | 162/25 |
| 2,935,931 A | | 5/1960 | Ginaven | 100/117 |
| 2,943,012 A | | 6/1960 | Dunning et al. | 162/18 |
| 2,972,171 A | | 2/1961 | Heritage | 19/72 |
| 2,975,096 A | | 3/1961 | Ginaven et al. | 162/18 |
| 3,098,785 A | | 7/1963 | Meiler | |
| 3,338,525 A | | 8/1967 | Asplund et al. | 241/17 |
| 3,446,699 A | | 5/1969 | Asplund et al. | 162/19 |
| 3,661,328 A | | 5/1972 | Leask | 241/18 |
| 3,765,611 A | | 10/1973 | Steiniger | 241/18 |
| 3,910,505 A | | 10/1975 | Reinhall | 241/18 |
| 4,136,831 A | | 1/1979 | Cederquist et al. | 241/18 |
| 4,372,495 A | | 2/1983 | Marton et al. | 241/28 |
| 4,372,810 A | | 2/1983 | Bystedt | 162/23 |
| 4,486,267 A | | 12/1984 | Prusas | 162/25 |
| 4,869,783 A | * | 9/1989 | Prusas et al. | 162/24 |
| 5,244,541 A | * | 9/1993 | Minton | 162/28 |
| 5,622,598 A | | 4/1997 | Prough | 162/52 |

FOREIGN PATENT DOCUMENTS

| | | | |
|---|---|---|---|
| EP | 0 034 560 | 8/1981 | |
| EP | 0 609 542 A1 | 10/1994 | D21B/1/12 |
| FI | 89610 | 3/1993 | |
| FR | 2356763 | 6/1977 | |
| WO | WO 89/10998 | 11/1989 | |
| WO | WO 91/12367 | 8/1991 | |
| WO | WO 91/19851 | 12/1991 | |
| WO | WO 92/1371 | 8/1992 | |
| WO | WO 92/13710 | 8/1992 | |
| WO | WO 94/16139 | 7/1994 | |
| WO | WO 95/34711 | 12/1995 | |
| WO | WO 96/41914 | 12/1996 | |
| WO | WO98/59107 | 6/1997 | |

OTHER PUBLICATIONS

"Refining Intensity and Pulp Quality in High–Consistency Refining", K. Miles, Paper and Timber 72(1990):5, pp. 508–514.

"A Simplified Method for Calculating the Residence Time and Refining Intensity in a Chip Refiner", K.B. Miles, Paper and Timber 73(1991):9, pp. 851–857.

"High Pressure Refining and Brightening in Thermomechanical Pulping", W.E. Lunan et al, 1983 Pulping Conference, pp. 239–253.

"Can we Reduce Energy Consumption in Mechanical Pulping?", Jan Sundholm, International Mechanical Pulping Conference (1993) Oslo, Norway, pp. 133–142.

* cited by examiner

*Primary Examiner*—Steve Alvo
(74) *Attorney, Agent, or Firm*—Alix, Yale & Ristas, LLP

(57) ABSTRACT

A method and apparatus for pretreating or conditioning lignocellulose fiber containing feed material in preparation for conversion to pulp. Wood chips are pretreated under conditions of elevated temperature, pressure and humidity and subsequently compressed to cause destructuring of the fibers of the feed material. The pretreated wood chips are then converted to pulp using such methods as the ground wood pulping process or chemical digestion process.

6 Claims, 11 Drawing Sheets

(100X MAGNIFICATION)

(100X MAGNIFICATION)

(100X MAGNIFICATION)

METHOD OF PRETREATING LIGNOCELLULOSE FIBER-CONTAINING MATERIAL IN A PULP REFINING PROCESS

BACKGROUND OF THE INVENTION

The present invention is related to the field of pulp production, more particularly the invention relates to the field of refining wood chips into pulp for paper manufacturing.

Two broad categories of pulp manufacturing techniques are known in the art. The first technique is known as the digestion process, wherein lignocellulose fiber containing material (wood chips) are treated with chemicals and heat in order to break down the structure of the wood chips and produce pulp suitable for use in the paper making process. A second technique for producing pulp, known as the mechanical pulping process, involves passing lignocellulose fiber containing material, such as wood chips, through an attrition device where the fibers of the wood chips are mechanically separated. Variations of the mechanical pulping process are also known and include the thermo-mechanical pulping process ("TMP"). In the TMP process, wood chips are fed into a pressurized pre-heater, treated with steam and are subsequently ground into pulp. U.S. patent application Ser. No. 08/736,366, filed Oct. 23, 1996, "Low-Resident, High-Temperature, High Speed Chip Refining", (now U.S. Pat. No. 5,776,305) discloses a further variation on the ground wood pulp process, whereby the wood chips are held at a temperature greater than the glass transition temperature ($T_g$) of the lignin in the wood chips for a period of time preferably less than 30 seconds, then immediately refined in a high speed disc refiner. According to the application, the wood chips are preferably subjected to a preheat environment of saturated steam at an elevated pressure in the range of 75–95 psi. (All values of pressure expressed as psi throughout this Specification including claims, refer to pounds per square inch gage pressure, i.e., psig). The assignee of the 08/736,368 application identifies the system and associated process as the "RTS".

In both the chemical digestion and mechanical pulping techniques of making pulp, pulp wood logs are fed to chipper machinery where the logs are cut and sheared into pieces appropriately sized for subsequent processing. Once in chip form, the material is fed to a digestion reactor vessel, mechanical refining apparatus, or the pre-heating stage of the mechanical refining apparatus.

SUMMARY OF THE INVENTION

The inventor of the present invention has found that pretreating the lignocellulose fiber containing chip material with heat, pressure and physical compression or, preferably, with moist heat, moisture, pressure and physical compression confers several beneficial effects which are realized in subsequent processing steps and in the quality of pulp obtained thereby. One benefit of pretreating the wood chips is that refiner intensity in the mechanical pulping process may be increased, fostering process energy savings. Also, improvements in the pulp strength properties and shive content of pulps obtained by pretreating the wood chips as described in this application may be noted.

The present invention comprises a method and apparatus for pretreating or conditioning lignocellulose materials and destructuring said materials, thereby fostering improved quality pulp and more economical pulp processing conditions. The invention is accomplished by subjecting lignocellulose materials, principally pulp wood chips, to conditions of elevated temperature, pressure and optionally, moisture, and preferably while the materials are under the influence of these conditions, physically compressing the materials at elevated compression levels in an amount sufficient to cause high levels of axial compression and thus destructuring of the wood chips.

Destructuring is defined as a significant separation of at least a portion of the fibers of the wood chips. This includes, but is not limited to, a separation of some or all of the wood fibers from one another along the longitudinal axis of the fibers. A characteristic of destructuring using the method and apparatus of this invention is that the destructuring causes significantly less damage to the wood fibers than if the chips were simply subjected to mechanical compression alone without pretreatment of heat, pressure and, optionally, moisture. For example, when wood chips are compressed without benefit of the conditioning step of this invention, a large proportion of the wood fibers tend to break across the grain of the fiber rather than separate from each other along the grain of the fiber. Breaking across the grain generates wood "fines" or minute particles of broken wood, and results in shorter pulp fibers. Both fines and short wood fibers generated by shattering or breaking are undesirable in the pulp processing industry.

The method of the invention comprises subjecting the wood chips to pretreatment conditions including a temperature in the range of 90–150° C., pressure in the range of 10–100 psi and optionally a moist atmosphere for a period of time prior to physical compression, wherein said pretreatment conditions are sufficient to promote destructuring of the wood chips when the chips are compressed at a ratio of from 4:1 or greater. The inventor envisions that a 3 to 180 second exposure time to pretreatment conditions of elevated temperature, pressure and moisture would be sufficient for pulping needs. However, a 3 to 60 second exposure to pretreatment conditions is preferred.

Practitioners in the art of pulp manufacturing will recognize the temperature and pressure ranges for the pretreatment conditions may need to be varied according to the pulping method being practiced. In TMP pulping, the pretreatment temperature may preferably be in the range of 90–120° C. and the pressure in the range of 15–25 psi. At temperatures above 120° C. some undesirable discoloration (darkening) of the wood chips or components thereof might occur. As the TMP process is practiced to obtain a suitably bright pulp for paper manufacture, anything which causes discoloration of the wood and pulp derived therefrom is to be minimized. This is primarily because most of the lignin, which contains the dark color bearing structures (i.e., chromophores), remains in the pulp following processing. On the other hand, in the kraft paper process, most of the lignin is removed from the pulp during pulping. Consequently, for the kraft process, heating in the pretreatment step to higher temperatures in the range of 120–150° C. and higher retention times is acceptable, i.e., a higher pretreatment temperature may be used in the chemical digestion pulping process as washing and bleaching of the pulp removes lignin, leaving the pulp white. In the kraft pulping and chemical digestion processes, higher pretreatment pressures in the range of 25–100 psi may be used.

The amount of compression to which the wood chips are subjected is expressed as a volummetric compression ratio, that is, the volume of the wood chips in an uncompressed state:the volume of the wood chips in a compressed state. According to the present invention, a compression ratio of 4:1 or greater provides the proper destructuring of the wood fibers. Generally, the destructuring can be accomplished in a compression ratio range of 4:1–8:1, with a preferred ratio in the range of 4.5:1–5.5:1.

Moisture is typically introduced to the pretreating process of the invention as a consequence of using steam as the heating medium. At the pressures and temperatures at which the process is practiced the steam is likely to be in a saturated state. It is possible, however, that a moist atmosphere could be obtained by simply introducing water into the heated and pressurized area, wherein the water would quickly turn to steam in that environment. Steam is the preferred way to add moisture, pressure and heat to the process, however it is foreseeable that means of heating, other than steam, could be practiced.

The compressive forces necessary to destructure the pretreated wood chips may be applied in various ways. One method of applying physical compression includes placing the wood chips between two plates or surfaces of a press and forcing the plates together to achieve the desired compression ratio. Where atmospherically presteamed wood chips are carefully aligned between the plates of a press so that compression force can be applied in a direction parallel to the longitudinal axis of the wood grain of the chips, they exhibit structural buckling, thereby indicating achievement of the desired result of a high level of separation between fibers at the S1–S2 interface. However, when atmospherically pre-steamed wood chips are compressed in this manner, a significant level of fiber shattering across the grain boundary of the fiber also occurs, thereby generating large numbers of fines. In the present invention, a high level of axially compressed wood chips is also desired, however, the conditioning of the wood chips by heating to elevated temperature levels in a pressurized environment and optionally, in the presence of moisture prior to compression reduces shattering and fines. It is believed that alignment of the wood chips as in these experiments, although feasible on a small scale, such as in a laboratory setting, would be not feasible for high volume operating requirements of commercial pulp and paper mills. Operation in a pressurized environment would also render axial alignment impractical. A viable alternative, and one which would be commercially acceptable, includes passing conditioned wood chips through a screw driven compression device. Such a device is exemplified by screw compression equipment sold under the registered trademark PRESSAFINER and commercially available from Andritz, Inc., Muncy, Pa. Other means of physically compressing and destructuring pretreated wood chips at elevated compression levels may be used. The compaction device should preferably produce a blend of destructured material with a high level of axially compressed wood chips present.

The apparatus of the present invention in its most basic embodiment comprises a conditioning chamber in communication with a compression device. The conditioning chamber is a vessel adapted for treatment of lignocellulose-containing feed materials under conditions of elevated pressure, elevated temperature, and optionally, moisture. Wood chips in the conditioning chamber are subjected to these conditions for a period of time in order to improve their processability in the compression device. The conditioning chamber may include means of transporting the wood chips through the chamber from a feed inlet to an outlet in communication with the compression device. Also, the conditioning chamber may include a rotary valve, plug screw feeder or other means to decouple the conditions within the chamber from ambient conditions, thereby allowing for effective conditioning treatment of the wood chips. The compression device is designed to receive conditioned feed materials from the conditioning chamber and compress them by mechanical means, thereby causing the fiber of the wood chips to separate and the chips to become destructured. The compression device of the present invention comprises a screw shaft rotatably mounted within a housing. The screw shaft is in spaced-apart relation with the housing, thereby defining a space around the shaft for movement and compression of the wood chips. Screw flights are disposed about the shaft in a generally helical fashion and are adapted for engaging the wood chips and impelling them from the inlet end of the compression device to the outlet end of the device. Compression of the wood chips is performed by moving the wood chips from an area of low compression in the compression device (in the region of the inlet) where the volume of space around the shaft is relatively large, to an area of high compression (toward the outlet) where the volume of space around the shaft is smaller. Compression occurs by impelling the wood chips into a decreasing volume space. In the present invention, the compression of the wood chips is practiced in the range of 4:1–8:1, wherein the ratio represents the relationship of the uncompressed volume to the compressed volume of a sample of wood chips.

In another embodiment of the invention an additional means of applying compression forces to the wood chips is envisioned. In this embodiment compression bolts are arranged to extend into the space around the screw compression shaft, thereby further decreasing the volume space and increasing compression. These bolts may be made adjustable so the distance they extend into the volume space around the shaft, and hence the additional compression they produce, can be altered to suit processing needs. It is also believed that the compression bolts, because they extend into the space around the shaft, make physical contact with at least a portion of the wood chips and "work" the chips, causing additional opening of the fiber structure. In those embodiments of the invention incorporating compression bolts, the bolts may be situated at the end of the screw shaft, or at one or more points along the shaft, preferably in the area of high compression along the shaft. In the event the compression bolts are located along the shaft the screw flights of the shaft are preferably made discontinuous, thereby providing a gap allowing the flighted shaft to rotate with clearance for the bolts.

The compression device of the present invention has features which are substantially as disclosed in published International Patent Application WO 92/13710, entitled "Adjustable Compression Screw Device and Components" and incorporated by reference herein.

Output from the compression device may be sent directly to pulp refiner equipment or held in a storage bin. The refiner equipment for use in connection with the invention includes, for example, TMP and RTS refiners, or it may be sent to a storage bin for a refiner on either a long or short term storage. In chemical pulping applications, the output of the compression device would feed the chemical digesters directly or via an intermediary storage bin. Various means may be employed for moving the chips from the compression device to the refiner or storage bin and include, for example, plug screw feeders and transfer conveyors. Further details of the apparatus of the invention will be apparent in the discussion of the drawings presented below.

DETAILED DESCRIPTION OF THE PREFERRED EMBODIMENT

Figure 1:
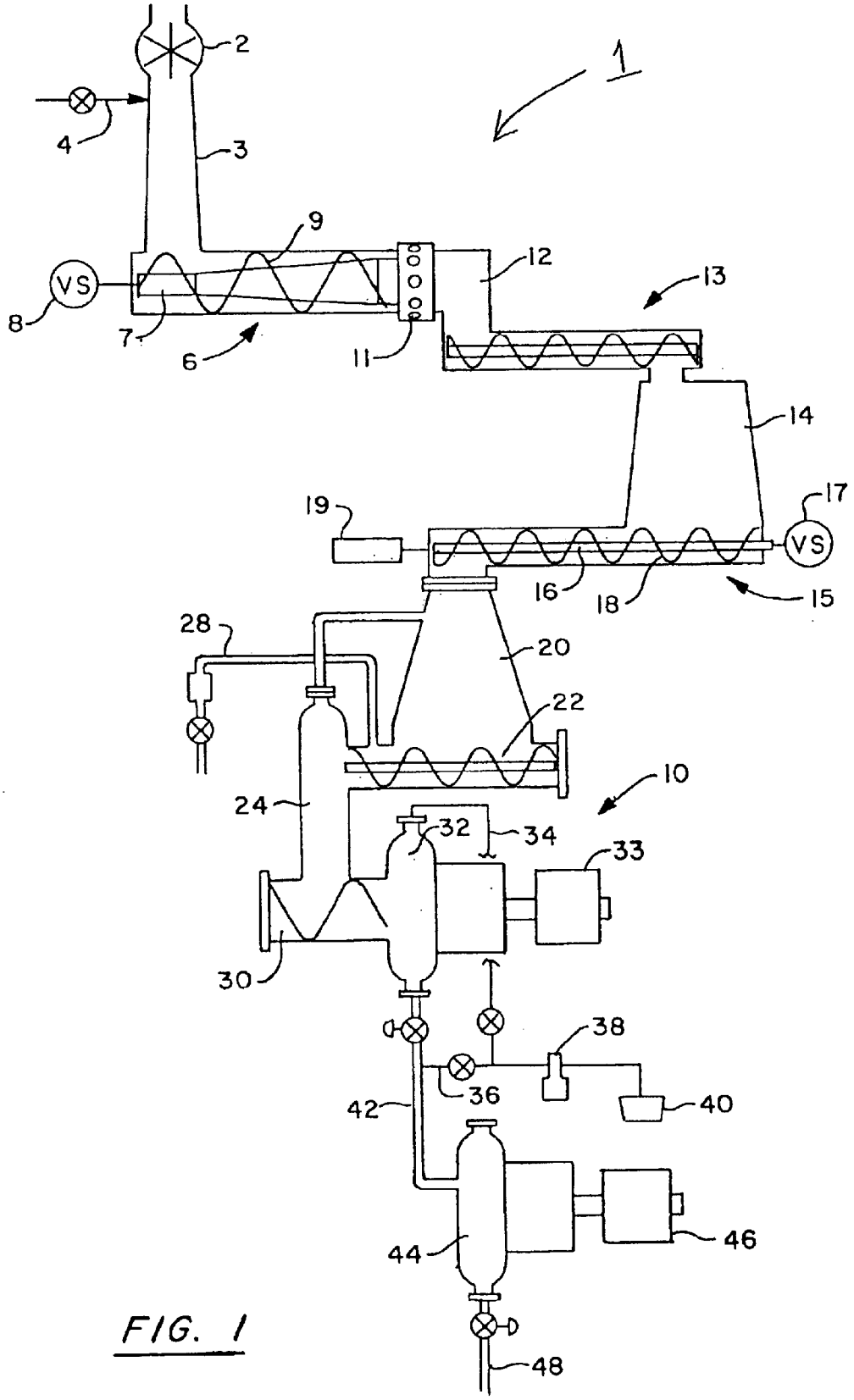
FIG. 1 is a schematic diagram of the wood chip conditioning equipment of the invention combined in an atmospherically decoupled arrangement with RTS rotating disc pulp refiner equipment.

FIG. 1 is a schematic diagram of conditioning equipment in an atmospherically decoupled arrangement with an RTS pulp refiner. In a first embodiment of the wood chip conditioning equipment 1 of the invention, wood chips are introduced to the conditioning equipment via rotary valve 2. The rotary valve allows chips to be transferred from a storage bin or other bulk feeding means which is open to the atmosphere and is otherwise at ambient conditions of pressure and temperature to the steam tube 3 where conditions of elevated pressure, temperature and optionally moisture are maintained. Other means of decoupling the conditioning equipment from the ambient conditions in which the chips are stored or transported may be used. The wood chips are resident in the steam tube for a period of time sufficient to condition the chips for subsequent compression. Typically, exposure to conditions of elevated temperature, pressure and optionally moisture for a period of 3–180 seconds is sufficient for pulping needs. However, it is envisioned that a 3–60 second exposure to pretreatment conditions is preferred.

The conditions within the steam tube include a temperature in the range of 90–150° C. and a pressure in the range of 10–100 psi. Optionally, the steam tube has a moist atmosphere. Heating of the steam tube may be accomplished by introducing steam directly to the tube via line 4. Those practitioners of ordinary skill in the art will recognize that other means may be employed to heat the steam tube and its contents to the operating temperatures of the invention. These means include electric heating coils disposed about the steam tube, or a jacket disposed about the steam tube for heating with steam. Those of ordinary skill in the art will recognize the advantages of introducing steam directly into the steam tube for purposes of heating as the steam may also be used to not only pressurize the steam tube to operating pressures but provide a moist atmosphere within the steam tube. If means other than introducing steam directly into the steam tube are used for heating the steam tube, additional means must be provided for raising the pressure within the steam tube to operating condition. This may be accomplished by such means as a pump or compressor which raises the pressure within the steam tube to operating condition. It will also be appreciated that if heating of the steam tube is accomplished with means other than introducing steam into the steam tube, if required for a particular embodiment of the process of the invention, moisture or water may be introduced to the steam tube along with the wood chips or through an inlet or other conduit means directly into the steam tube itself.

The conditioned wood chips pass to the inlet end of the screw compression unit 6. The screw compression unit features a screw shaft 7 driven by a variable speed motor 8. Disposed along and about the shaft in a generally helical fashion are compression screw flights 9. The screw flights impel the wood chips toward the outlet end of the screw compression device as the shaft is rotated. In FIG. 1, the rotatable screw shaft is outwardly tapered from its narrow, low compression, wood chip inlet end to its wider, high compression, outlet end of the compression unit. Compression of the wood chips in this embodiment is accomplished by the screw flights impelling the wood chips into an ever-decreasing volume space about the shaft. Also, the level of compression in the compression unit may be enhanced through the use of a restrictor bolt section 11. The restrictor bolt section includes bolts or other projections which extend into the space around the shaft further reducing the volume space in that region and make contact with the wood chips passing through the unit in a manner which "works" the wood chips, destructuring them even further. Those practitioners of ordinary skill in the art will recognize that the desired compression ratio of from 4:1–8:1 of the invention can be attained through various means, including adjusting the volume space about the shaft by altering the taper of the shaft or profile of the housing in which the shaft rotates, changing the pitch of the flights, and adjusting the degree of restriction imposed by the restrictor bolt section. These examples are not intended to limit in any way the means by which the compression aspect of the present invention is accomplished.

As the compressed wood chips leave the outlet end of the compression device they are carried by transfer conveyor 13 to storage bin 14. In the embodiment shown in FIG. 1, the transfer conveyor and storage bin are both under ambient conditions, although it is within the scope of this invention to maintain the compressed wood chips at elevated pressure and temperature until being further processed. For example, when the compressed wood chips have an undesirably low moisture content, water and/or chemicals may be added to the chips by way of water impregnation or chemical impregnation. As a further example, bleaching chemicals may be added by way of chemical impregnation. It is preferred that such water or chemical impregnation be carried out as the wood chips are discharged from the compression device. From the storage bin, the wood chips are conveyed by plug screw feeder 15 to chamber 20 of, preferably, an RTS refiner system 10. The plug screw feeder features a rotatable screw shaft 16 which is rotated by variable speed motor 17. Disposed in a helical fashion about the rotatable screw shaft of the plug screw feeder are screw flights 18. When the screw shaft is rotated, the plug screw flights impel the conditioned wood chips toward the outlet ends of the plug screw feeder. The plug screw feeder is designed to cause a degree of crowding of the transported material thereby making a plug of material which effectively atmospherically decouples the downstream outlet end of the plug screw feeder from the inlet end in communication with the storage bin. Formation of a plug and the atmospheric decoupling of these portions of the apparatus are necessary as the chamber 20 is maintained at a high level of pressure and temperature. In order to prevent the blow back of the plug toward the inlet end of the screw feeder, an air cylinder 19 provides pressure relief, thereby preventing the refiner pressure from blowing through the plug.

Once in the chamber 20 of the RTS refiner system, the chips are maintained under conditions of elevated temperature, pressure and moisture as required by the RTS preheating process. The conditioned chips are conveyed along variable speed screw 22 to the steam separation chamber 24. Steam from the separator 24 is routed to chamber 20 for heating and treatment of the wood chips. Water or other treatment chemicals may be added to the mixture through line 28. In this portion of the apparatus, the chips experience a saturated steam preheat at a temperature at least 10° C. above $T_g$, for a total residence time through vessel 20, screw 22 and separator 24 of between 5–10 seconds.

The preheated wood chips are then driven by a high speed ribbon feeder 30 into the primary refiner 32 which is powered by motor 33. In a single disc refiner (as shown as 32), the rotating disc operates at a speed greater than 1800 rpm, preferably above 2200 rpm. In a double counter rotating disk refiner, the disks each rotate at a speed greater than 1500 rpm, preferably above 2,000 rpm. Bleaching agents and other chemicals can be introduced into the pulp at primary refiner 32 through lines 34 and 36 by metering system 38 from bleaching agent reservoir 40. The primary pulp is fed through line 42 to the secondary refiner 44 which is driven by motor 46. The refined pulp of the secondary refiner is transferred by line 48 to a storage facility or other apparatus for further processing into a final product.

Figure 2:
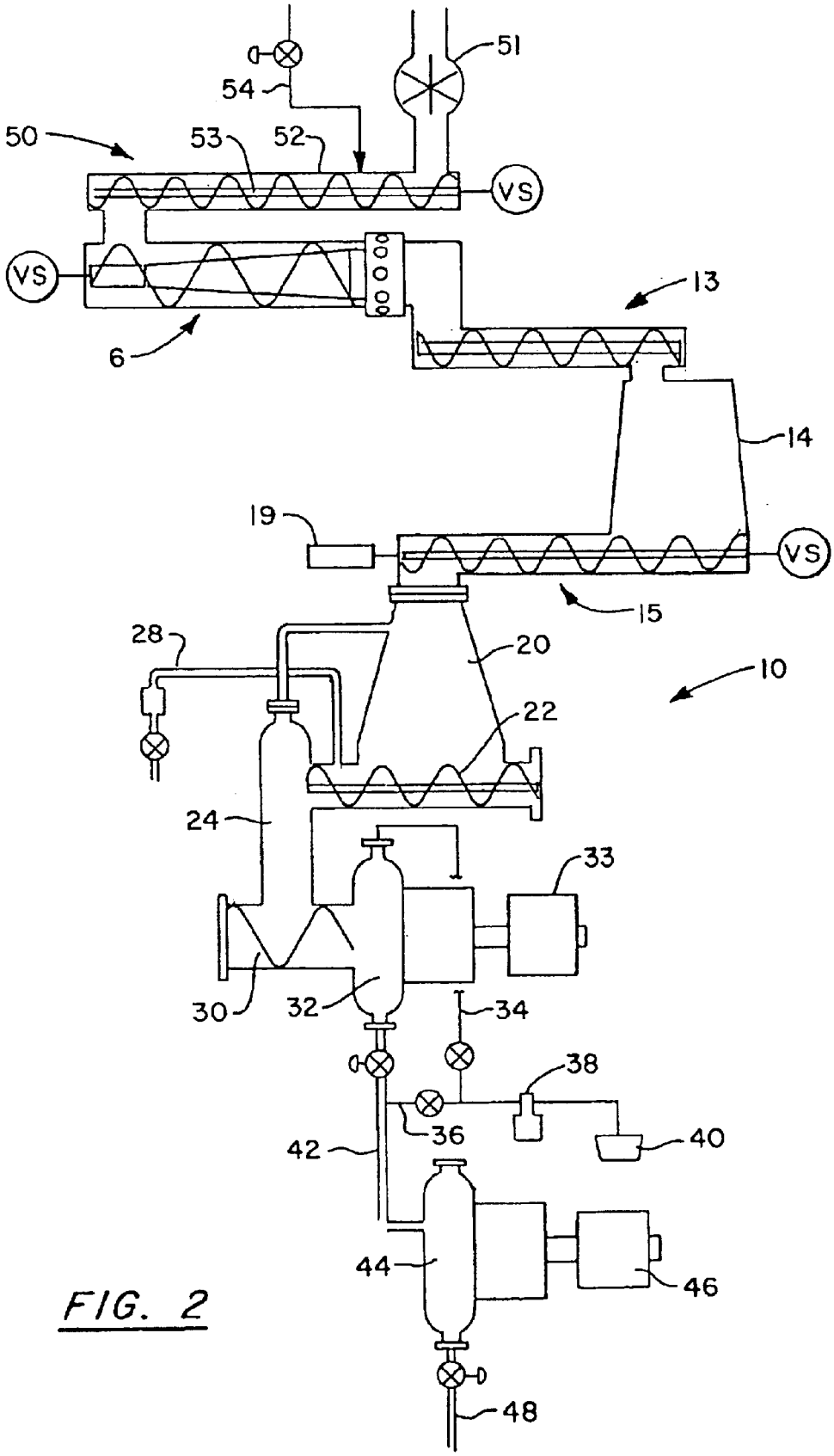
FIG. 2 is a schematic diagram of a second embodiment of the wood chip conditioning equipment of the invention combined in an atmospherically decoupled arrangement with RTS rotating disc pulp refiner equipment.
Figure 3:
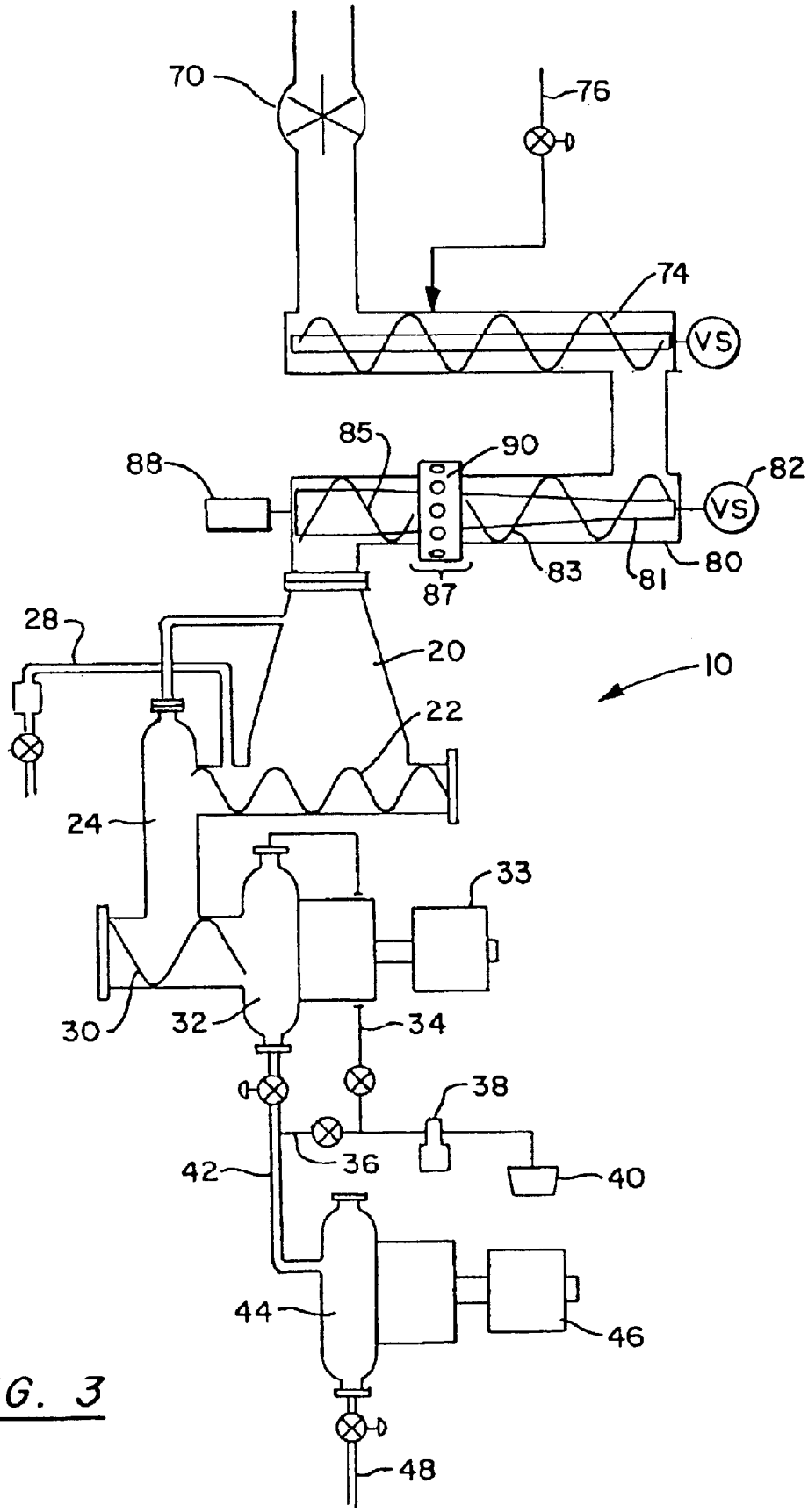
FIG. 3 is a schematic diagram of a third embodiment of the wood chip conditioning equipment of the invention combined in an atmospherically coupled arrangement with RTS rotating disk pulp refiner equipment.

In the embodiment of FIG. 1, the steam tube can be considered a passive inlet portion of the compression unit 6. It should be appreciated that the pre-treatment process 1 according to the invention, may be implemented in hardware in which steam tube or chamber 3 is distinct from compression unit 6, for example as shown in FIGS. 2 and 3. In the embodiment of FIG. 1, a plug is formed immediately upstream of 11, before expansion at atmospheric pressure at 12. The plug in effect decouples the pre-treatment at elevated temperature and moisture in process 1, from the atmospheric pressure in storage bin 14. Alternatively, the conveyor 13, bin 14 and plug screw feeder 15 can be omitted, and a specially adapted Pressafiner screw device, such as described with respect to FIG. 3 below, can be employed to introduce pre-treated material directly into the refiner pre-heating chamber 20. Similarly, the RTS refining system 10 can have a variety of configurations. For example, in some installations, the chamber 20 may be eliminated, because even when present, the level of wood chips therein is very low, whereby the retention time of the material at the temperatures of $T_g$, can be controlled substantially entirely by controlling the speed of the variable speed conveyor 22.

Further details regarding the preferred refiner system 10 are set forth in pending U.S. patent application Ser. No. 08/736,366, the disclosure of which is hereby incorporated by reference.

In FIG. 2, a schematic diagram of conditioning equipment in an atmospherically decoupled arrangement with an RTS pulp refiner is shown. Wood chips are fed to the apparatus through rotary valve 51. The rotary valve is in communication with the inlet end of a variable speed pressurized conveyor 52 which is pressurized and heated by steam line 54. The screw flights of rotating screw shaft 53 impel the wood chips from the inlet ends of the pressurized conveyor to the outlet end of the pressurized conveyor. The outlet end of the pressurized conveyor is in communication with the wood chip compression unit 6. Those of ordinary skill in the art will recognize that the compression units, transfer conveyor 13, atmospheric bin 14, plug screw feeder 15 and RTS refiner 10 are identical to that previously described in regard to FIG. 1. An additional embodiment of the apparatus shown in FIG. 2 includes the apparatus as described, but with the substitution of the rotary valve 57 by a side-entry plug screw feeder.

FIG. 3 shows yet another embodiment of the apparatus and method of the invention. Wood chips are introduced through rotary valve 70 to the variable speed pressurized conveyor 74. As is shown in the drawing of FIG. 3, a steam line 76 is used to introduce steam to the interior of the pressurized conveyor. The steam heats and pressurizes the wood chips being transported through the conveyor and also subjects them to moisture. It is within the scope of this invention that other means be used to subject the wood chips to conditioning levels of heat, pressure and, optionally, moisture. These other means include dry heating of the wood chips through electrically resistive wires disposed around the pressurized conveyor, or indirect heating of the pressurized conveyor through steam jackets or other alternative heating media. In the event one of the dry heating methods is used to heat the wood chips, moisture may still be introduced in the process through water injectors or other ways of introducing water or water vapor into the process equipment. Also, when one of the dry heating methods is used, a pump or compressor device must be used to condition the wood chips under pressure, this being necessary to emulate conditions when steam is used to heat and pressurize the conditioning equipment directly. The pressurized conveyor moves the wood chips from the inlet end to the outlet end thereof and the outlet of the pressurized conveyor is then in communication with a wood chip compression unit 80 featuring a rotatable compression screw shaft 81 driven by a variable speed motor 82. The screw shaft features a first flight section 83, a second flight section 85 and a flightless zone 87, a portion of screw shaft without flights, by which the first flight zone and second flight zone are spaced apart. As in other embodiments, the compressive forces imposed upon the wood chips are caused by impelling the wood chips into a decreasing volume space about the shaft and additionally, by forcing the wood chips through a region of the unit where constrictor bolts 90 create additional compression which acts on the wood chips. In this embodiment of the invention, the constrictor bolts are located a distance set back from the outlet end of the compression device. The constrictor bolts in this embodiment are disposed in a generally radial pattern around the screw shaft in the interrupted flight zone (flightless zone) of the compression device. As in previous embodiments, the constrictor bolts exert additional pressure on the wood chips being impelled through the compression device and also act to "work" the wood chips and aid in destructuring and opening the fibers of the chip. The outlet end of the compression unit is in communication with the inlet portions of the RTS refining equipment 10. An air cylinder 88 is used at or near the outlet end of the compression unit to prevent the higher atmospheric pressure found in the RTS refiner portion of the apparatus from blowing through the plug of wood chips formed in the compression unit. Other features of the RTS refiner portion of this apparatus shown in FIG. 3 are as previously described in FIGS. 1 and 2.

Figure 4:
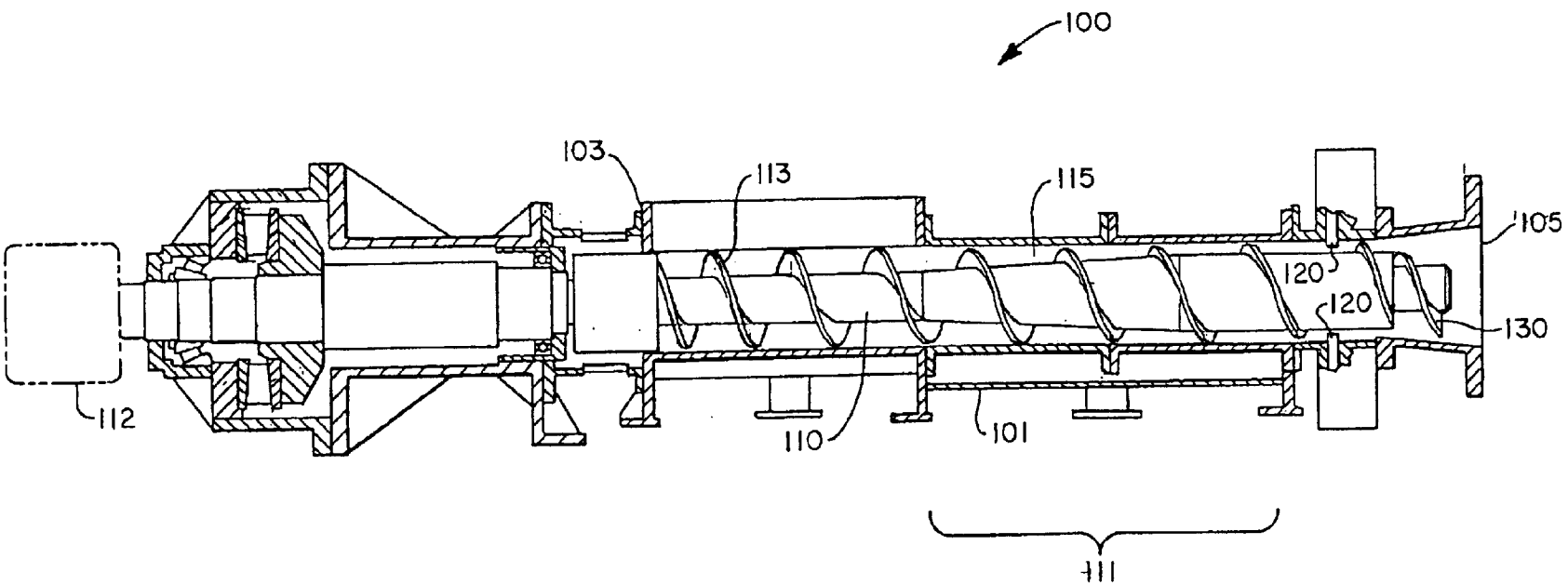
FIG. 4 depicts a longitudinal sectional view of one embodiment of a compression unit for implementing the invention.

FIG. 4 depicts a longitudinal sectional view of one embodiment of the wood chip compression unit of the present invention. This embodiment is an improvement to the conventional MSD PRESSAFINER available commercially from Andritz, Inc. In this embodiment, the wood chip compression unit 100 comprises a housing 101 having an inlet end 103 and an outlet end 105. In operation, the inlet housing (not shown in FIG. 4) is in communication with the conditioning chamber and is preferably configured to permit pressurization of the inlet to process condition pressures. Within the housing is a rotatably mounted screw shaft 110 having one or more screw flights 113 disposed about the shaft in a helical arrangement for impelling the wood chips out of the inlet, causing compression of the wood chips, and impelling the wood chips out of the compression unit at the outlet. The screw shaft is preferably driven by a variable speed motor 112. It will be noted that this embodiment of the compression unit features a screw shaft with a tapered portion 111 for imparting compressive forces to the wood chips. It will be noted that the tapered portion of the screw shaft is widest at the end nearest the outlet of the compression unit and narrowed at the inlet portion of the compression unit. This taper to the shaft allows the compression volume space 115 to gradually decrease toward the outlet end of the unit. Wood chips introduced at the inlet are impelled by the screw flights toward the tapered portion of the shaft and the region of decreasing volume space, i.e., the compression zone of the unit.

This embodiment of the invention shown in FIG. 4 features restrictor bolts 120 near the outlet end of the compression unit. The restrictor bolts serve to increase the compressive forces imposed upon the wood chips by further decreasing the flow cross-section about the shaft through which the chips are forced to pass. The restrictor bolts are adjustable so that the length of the bolt protruding into the space about the shaft can be adjusted by the operator. This adjustability of the restrictor bolts permits the operator to adjust the compression of the unit as demanded by the process. The restrictor bolts also serve to "work" the wood chips which pass through the restrictor bolt region of the unit, further opening, or otherwise destructuring, the fibers of the wood chips. In the embodiment shown in FIG. 4, a short helical impeller screw flight is located downstream of the restrictor bolts at the outlet of the compression unit. The impeller screw 130 serves to move the already compressed wood chips from the unit to the next phase of the pulp process. It will be noted that in the embodiment shown the housing of the unit flares outward at the outlet, thereby increasing the volume space in that area. It is not believed that the impeller screw imposes any additional compression on the wood chips. Rather, the impeller screw merely serves to move the opened wood chips to the next phase of the pulp refining process.

Figure 5:
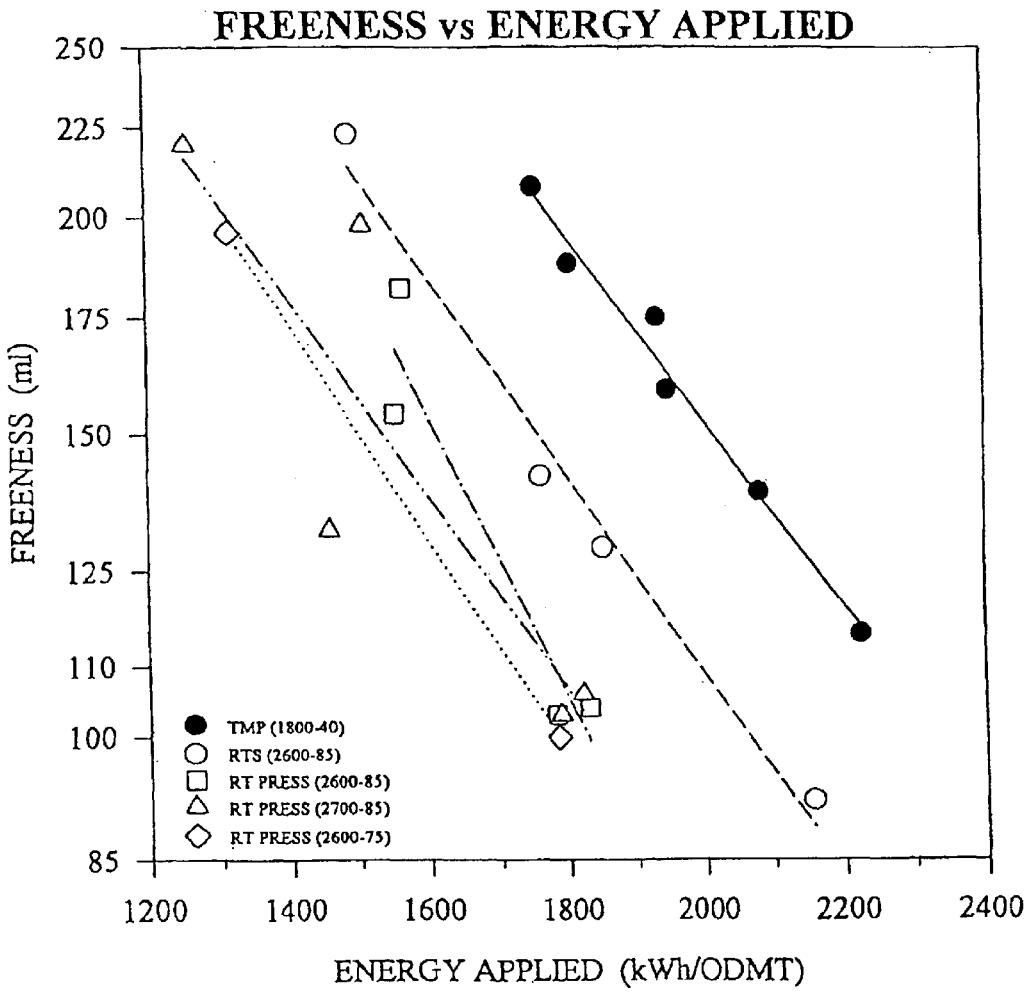
FIGS. 5–11 are graphs showing various performance aspects of pulp made according to the invention compared to other pulps.
Figure 6:
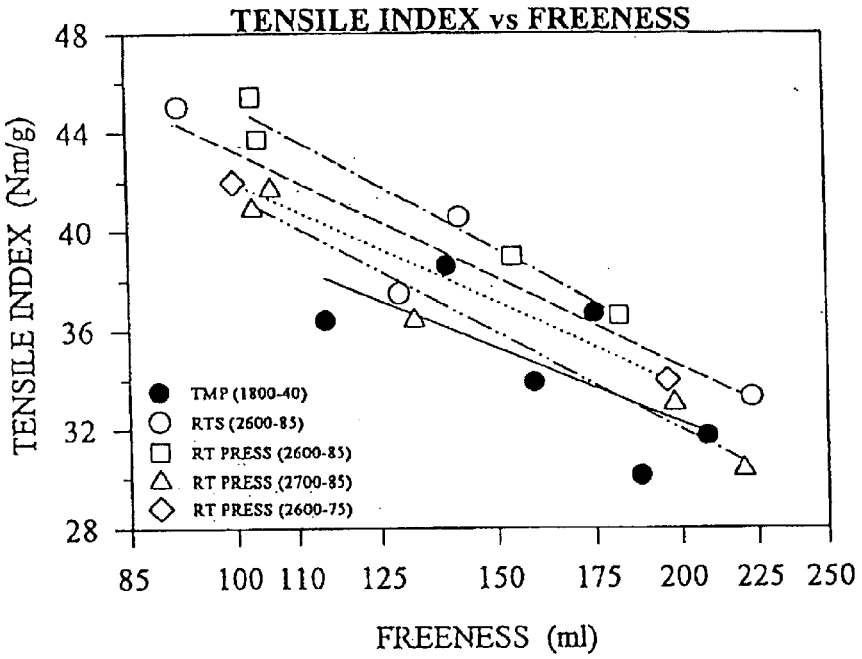
Figure 7:
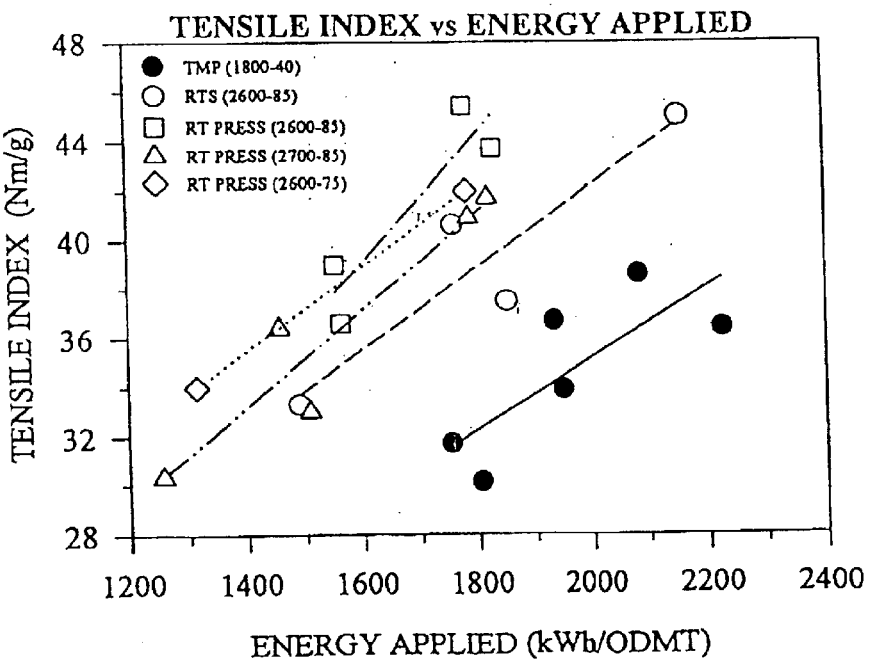
Figure 8:
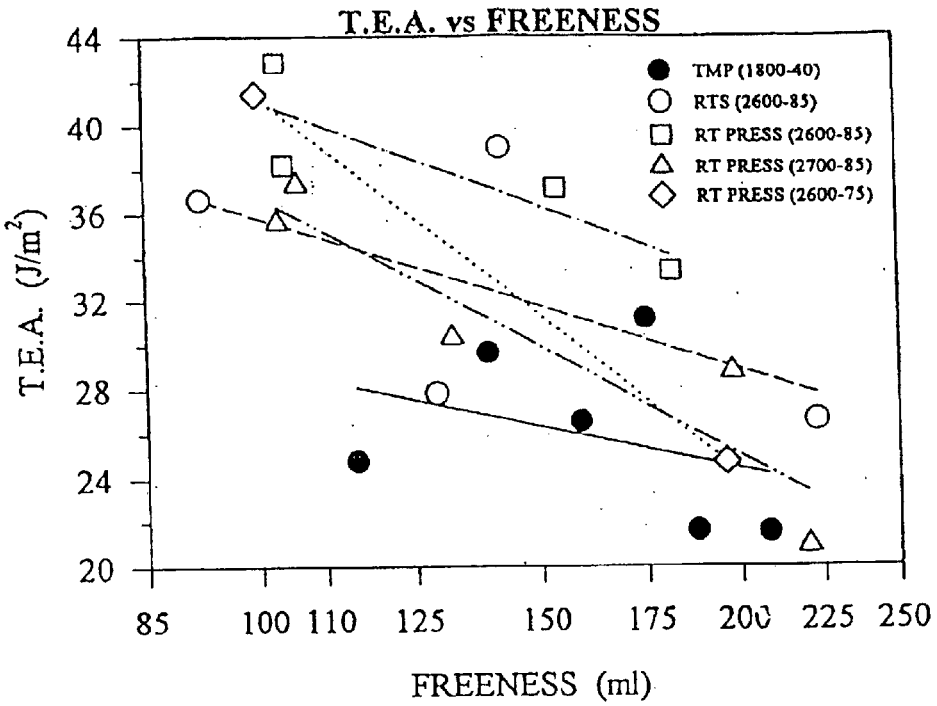
Figure 9:
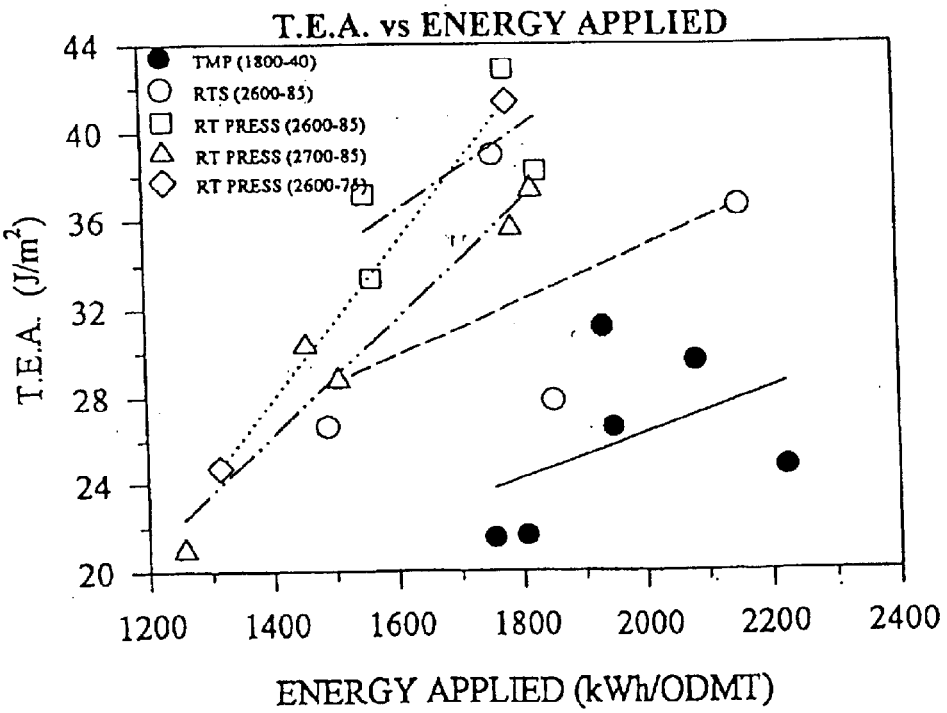
Figure 10:
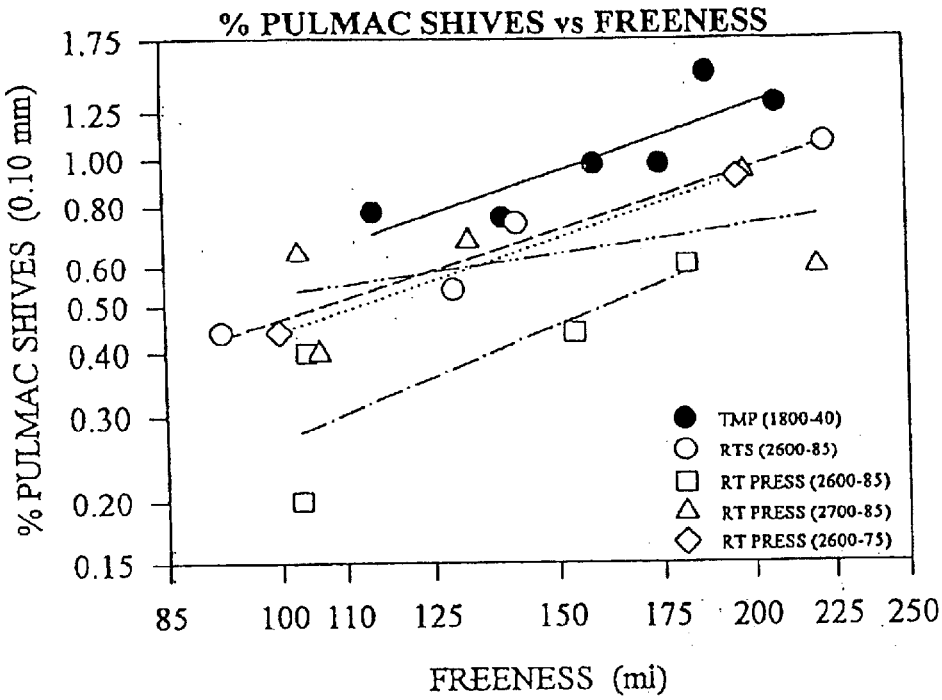
Figure 11:
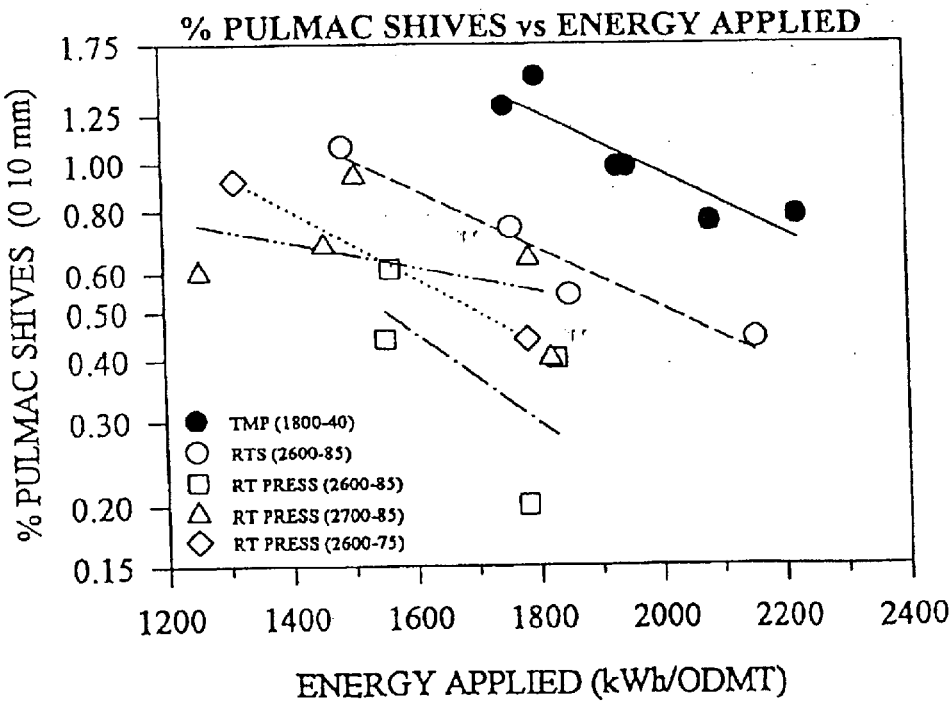

The inventor performed a number of experiments to evaluate the effect of the wood chip pretreatment process of the invention on RTS and conventional TMP pulp with a view toward determining whether any savings in specific energy requirements accrued when the pretreatment method was employed. The inventor discovered that wood chips which were pretreated with the process of the invention and refined at RTS conditions demonstrated a reduction in the specific energy required for refining compared to conventional TMP. This reduction was in the range of 448–511 kWh/ODMT, as further shown in FIG. 5. By comparison, wood chips which were not treated according to the process of the invention, but were refined at RTS conditions demonstrated only a 315 kWh/ODMT reduction in specific energy compared to conventional TMP. The experimental results also indicate that pretreatment of the wood chips according to the invention could permit a further increase in primary refiner intensity which would result in additional energy saving. Increasing the disc speed of the primary refiner from 2600 rpm to 2700 rpm yielded additional savings in energy while maintaining improved pulp quality compared to conventional TMP pulps.

In addition to energy savings, the inventor discovered that pulps which were refined from wood chips pretreated according to the present invention had the highest strength properties and lowest shive content at a given freeness or specific energy compared to other processes evaluated, as shown in FIGS. 6–11. The experiments also revealed that in order to obtain the most benefits from the pretreatment process of the invention, it is most preferable to feed the pretreated wood chips directly to the refiner system without cooling, loss of moisture, or pressure. In this way, further increases in TEA index and reduction in shive content are possible.

Figure 12:
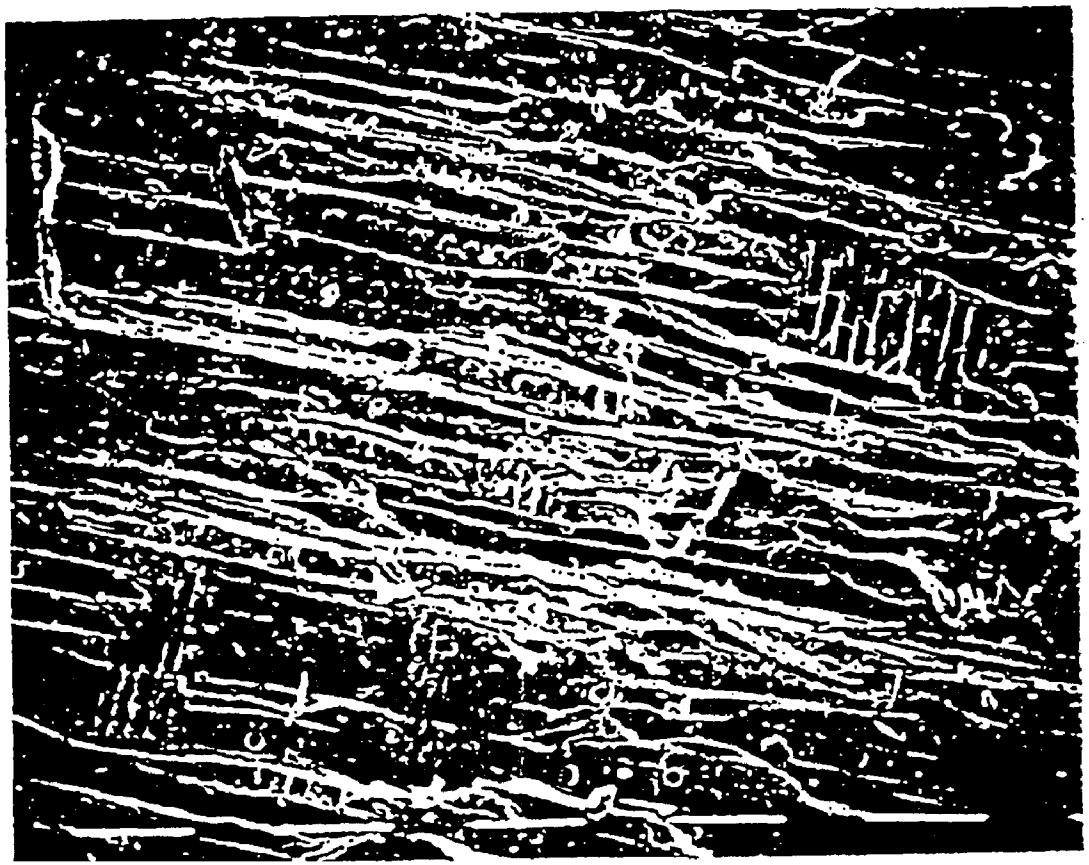
FIG. 12 is an electron photomicrograph (100× magnification) of a wood chip which has not been conditioned, compressed, or otherwise pretreated.

FIG. 12 is an electron photomicrograph (100× magnification) of a wood chip which has not been conditioned, compressed, or otherwise pretreated. The micrograph shows the intact rigid fiber structure of the wood and lack of separation of the individual softwood fibers along their longitudinal axis.

Figure 13:
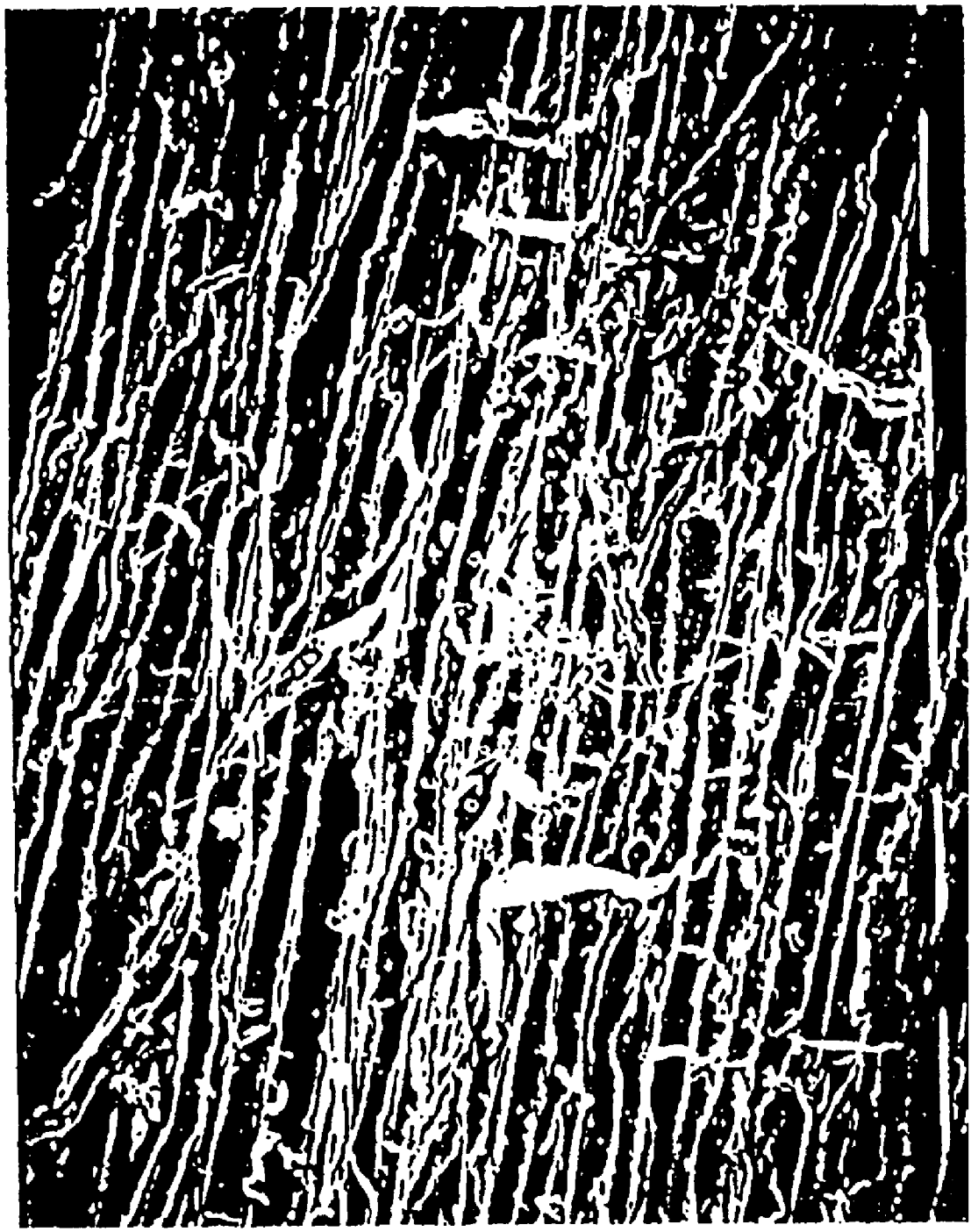
FIG. 13 is an electron photomicrograph (100× magnification) of a wood chip which has undergone steam heating and pressurization at 22 psi, and high compression at a 5:1 compression ratio according to the present invention.

FIG. 13 is an electron photomicrograph (100× magnification) of a wood chip conditioned and compressed according to the present invention, wherein the chip was exposed to steam heating and pressurization at 22 psi, followed by high compression at a 5:1 compression ratio. The micrograph shows a high level of axial separation along the longitudinal axis of the individual softwood fibers. Some surface delamination is also in evidence, which may explain the improved bonding strength results as shown in connection with FIGS. 6 and 7.

Figure 14:
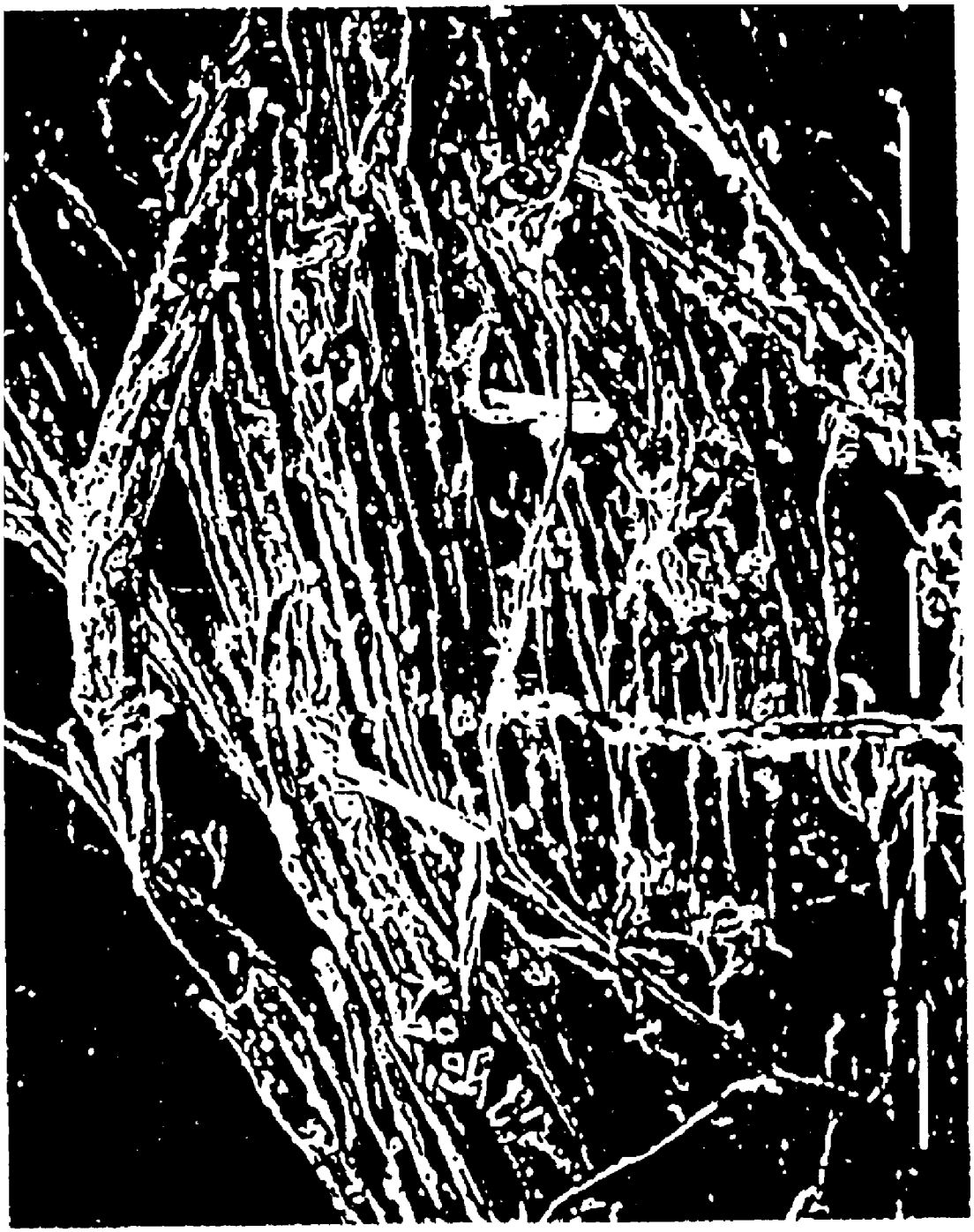
FIG. 14 is an electron photomicrograph (100× magnification) of a wood chip which has received atmospheric steaming treatment, followed by 4:1 compression.

FIG. 14 is an electron photomicrograph (100× magnification) of a wood chip which has been atmospherically pre-steamed, then compressed at a 4:1 compression ratio. A high level of axial separation of fibers is noted in this micrograph, but this is tempered by the large number of fractured fibers. The presence of fibers sheared in the compression step is also noted. Some sheared fibers appear in the lower central region of the micrograph. They are identified by the somewhat flattened "O" shape of the sheared end of the fiber.

Wood samples for these experiments were obtained from Stora SFI of Hawkesbury, Nova Scotia, Canada and blended according to the following distribution:

48% balsam fir

27% black/red spruce

18% white spruce

7% pine/hemlock/larch

In Table A an experimental comparison of the pulp quality obtained by the process of the invention is shown. All wood chips processed in the experiment set forth in Table A were drawn from the wood chip mix described herein above.

In Example 1 wood chips were pretreated according to the invention, wherein they were subjected to a saturated steam atmosphere at 22 psi and 128° C. for a period of six seconds. The wood chips of Example 1 were then subjected to compression in a PRESSAFINER screw compression device where a compression ratio of 5:1 was achieved. The wood chips were fed to a pressurized single disc refiner (Andritz Model 36-ICP 91 cm (36 inch) diameter) operating at the speed and pressure shown in Table A (i.e., RTS operating conditions).

In Comparative Example 1 a sample of wood chips was exposed to steam under ambient atmospheric conditions for a period of 25 minutes. The steamed chips were then compressed in a PRESSAFINER compression device under conditions suitable to achieve a compression ratio of 4:1.

In Comparative Example 2, the sample of wood chips did not undergo either pretreatment with heat, temperature and pressure or mechanical compression. Rather, the wood chips of Comparative Example 2 were placed directly in the RTS refiner system without receiving pretreatment as in the present invention.

After refining under conditions of a refiner pressure of 85 psi and refiner speed of 2600 rpm the pulps obtained from the Examples were examined for various properties and qualities. The results from these examinations are presented below in Table A.

TABLE A

| | EXAMPLE 1 | COMPARATIVE EXAMPLE 1 | COMPARATIVE EXAMPLE 2 |
|---|---|---|---|
| Pretreatment | Heat, Pressure, Moisture 128° C., 22 psi, 6 seconds; 5:1 Compression | Atmospheric Pressure 25 minutes, Steam; 4.1 Compression | None |
| Inlet Pressure (psi) | 22 | Ambient | Ambient |
| Refiner Process | RTS | RTS | RTS |
| Process Pressure (psi) | 85 | 85 | 85 |
| Refiner Speed (rpm) | 2600 | 2600 | 2600 |
| Freeness (ml) | 103 | 104 | 104* |
| Spec. Energy (kWh/ODMT) | 1782 | 1954 | 1987 |
| Bulk | 2.54 | 2.52 | 2.51 |
| Burst Index | 2.5 | 2.3 | 2.2 |
| Tear Index | 9.6 | 8.6 | 9.1 |
| Tensile Index | 45.4 | 42.9 | 43.5 |
| Opacity | 96.7 | 96.1 | 96.5 |
| Brightness (% ISO) | 50.9 | 50.9 | 51.4 |
| % Shive Content | 0.20 | 0.26 | 0.46 |
| Sample I.D. | A18 | A9 | |

* Interpolated at 104 ml

The performance of Example 1 demonstrates improved strength properties including burst index, tear index and tensile index. In addition, the specific energy required for producing the pulp in Example 1 was found to be 172 kWh/ODMT lower than required for the pulp produced in Comparative Example 1. In terms of appearance, opacity and brightness, Example 1 and Comparative Examples 1 and 2 were similar. However, Example 1 was determined to have a slightly lower percent shive content compared to Comparative Example 1, and a significantly lower percent shive content compared to Comparative Example 2.

Experiments were conducted to determine the effect of allowing wood chips which had been conditioned and compressed according to the invention to cool to room temperature prior to refining. In these experiments a sample of wood chips was pretreated and compressed according to the invention and one half of the sample was fed immediately to the RTS pulp refiner while still at their conditioned temperature. These wood chips, constituting Example 2, were at a temperature of approximately 90° C. when fed to the refiner. The other half of the sample was allowed to cool to room temperature (23° C.) before being fed to the same RTS refiner. These latter wood chips are identified as Comparative Example 3.

The results of the experiments conducted on these two groups of wood chips is presented below in Table B.

TABLE B

| | EXAMPLE 2 | COMPARATIVE EXAMPLE 3 |
|---|---|---|
| Pretreatment | Per Invention | Per Invention |
| Chip Temp (° C.) | 90 | 23 |
| Primary Refiner Speed (rpm) | 2700 | 2700 |
| Primary Refiner Pressure (psi) | 85 | 85 |
| Retention time (sec) | 11 | 11 |
| Sample I.D. | A14 | A18 |
| Freeness (ml) | 106 | 103 |
| Specific Energy (kWh/ODMT) | 1822 | 1789 |
| Bulk | 2.69 | 2.52 |
| Burst Index | 2.3 | 2.4 |
| Tear Index | 10.0 | 9.2 |
| Tensile Index | 41.7 | 40.9 |
| % Stretch | 2.11 | 2.08 |
| T.E.A. | 37.34 | 35.60 |
| % Opacity | 95.8 | 96.1 |
| Brightness | 50.9 | 50.6 |
| % Shives | 0.40 | 0.64 |
| +28 Mesh | 31.4 | 30.3 |

The pulp produced in Example 2 showed slightly higher tear index and a lower shive content compared to the pulp produced from the wood chips treated as in Comparative Example 3. This is to be expected from the higher level of thermal softening achieved in the wood chips of Example 2 prior to the primary refining step. The remaining properties of the two examples, including the energy requirements, were quite similar. The results indicate that the RTS system refining conditions of 85 psi and 11 second retention are such that the cooled chips must be heat shocked quite rapidly in order to withstand the high speed (2700 rpm) refining conditions.

A series of analytical tests were conducted to determine the comparative differences of long fiber strength properties in pulps processed according to the TMP process, RTS system process and the process of the present invention (designated in the table as RTPR). The test samples of wood pulp obtained from these various processes were fractionated using the well-known Bauer McNett technique to remove the +14 and +28 mesh size fractions for analysis. The fractionated fibers were then analyzed for hand sheet strength and bulk, and were also subjected to fiber size distribution analysis performed on FIBERSCAN analytical equipment, commercially available from Andritz, Inc. Muncy, Pa. The results of the analysis are presented below in Table C.

TABLE C

| | Comparative Example 4 | Comparative Example 5 | Example 3 | Example 4 | Example 5 | Example 6 | Example 7 |
|---|---|---|---|---|---|---|---|
| Sample ID | A5 | A10 | A18 | A23 | A12 | A14 | A18 |
| Process and Refiner Speed (rpm) | TMP | RTS | RTPR (2600) | RTPR (2600) | RTPR (2600) | RTPR (2700) | RTPR (2700) |
| Ref. Pressure (PSI) | 40 | 85 | 85 | 85 | 75 | 85 | 85 |
| Freeness (ml) | 115 | 129 | 103 | 104 | 100 | 106 | 103 |
| Tensile (Nm/g) | 12.8 | 14.4 | 15.1 | 14.8 | 14.5 | 17.2 | 18.0 |
| % Stretch | 0.76 | 0.72 | 0.77 | 0.72 | 0.81 | 0.80 | 0.83 |
| T.E.A. | 3.48 | 4.35 | 4.39 | 4.00 | 4.61 | 4.95 | 5.35 |
| BULK ($cm^3/g$) | 4.27 | 3.65 | 4.42 | 4.44 | 4.19 | 3.88 | 4.08 |
| LW AVE. (mm) | 2.15 | 2.10 | 2.15 | 2.15 | 2.12 | 2.21 | 2.10 |
| Width Index | 14.86 | 14.56 | 14.70 | 14.11 | 14.93 | 14.96 | 14.24 |
| Report | 1611 | 1611-4 | 1611 | 1611 | 1611-3 | 1611-2 | 1611-2 |

The +14 and +28 fraction of the RTS and RTPR pulps were found to have higher tensile and T.E.A. strength properties compared to the conventional TMP long fiber fraction.

The use of the process and apparatus of the present invention in connection with chemical pulping offers some obvious benefits over conventional chemical pulp digestion techniques. Destructuring of the wood chips according to the present invention would improve the penetration and diffusion of the digestion chemicals, reduce the amount of digestion chemicals needed to produce a pulp of a given quality, and reduce pulp rejects caused by cooking oversized wood chips.

Tests were conducted comparing the performance of pulps obtained from mixed samples of wood chips from Stora SFI (described above). The results of the tests are presented in Tables D and E, below. In Table D, the wood chips of Comparative Example 6 were subjected to a conditioning treatment consisting of atmospheric steaming and 4:1 compression, but the wood chips of Comparative Example F received no pretreatment or compression. Both examples were processed to pulp using the kraft pulping process. The digestion conditions include a rise to temperature of 1.5 hours and a cooking temperature of 170° C. Table D below compares the pulp performance results.

TABLE D

| | Comparative Example 6 | Comparative Example F |
|---|---|---|
| Pretreatment | 4:1 Compression | None |
| Atmospheric Presteaming | Yes | No |
| Yield % | 48.3 | 48.1 |
| Tensile Index (Nm/g) | 63.7 | 69.4 |
| Tear Index (mN.m2/g) | 17.8 | 22.1 |
| % + 28 Mesh | 68.8 | 80.1 |
| % − 200 Mesh | 10.2 | 4.1 |

It was noted that compression of the atmospherically steamed wood chips exhibited shortened fiber length and a high level of fines due to fiber breakage upon compression.

In Table E, additional tests were conducted wherein the wood chips of Example 8 were subjected to conditioning treatment according to the invention followed by 5:1 compression and a the wood chips of Comparative Example 8 which received no pretreatment or compressing, both of which were processed to pulp using a kraft pulping process. The digestion conditions include a rise to temperature of 1.5 hours and a cooking temperature of 170° C. Table E below compares the pulp performance results.

TABLE E

| | Example 8 | Comparative Ex. 8 |
|---|---|---|
| Pretreatment | 5:1 Compression | None |
| Inlet Pressure (psi) | 22 | — |
| Active Alkali (%) | 23 | 23 |
| Sulphidity (%) | 18 | 18 |
| L:W Ratio | 6 | 6 |
| Freeness (ml) | 684 | 682 |
| BULK ($cm^3/g$) | 1.89 | 1.90 |
| Tensile Index (Nm/g) | 78.8 | 77.8 |
| % Stretch | 2.76 | 2.47 |
| T.E.A. ($J/m^2$) | 80.96 | 79.5 |
| Tear Index ($mN.m^2/g$) | 16.7 | 17.5 |
| Shive content (%) (0.15 mm) | 0.65 | 3.80 |
| % + 28 Mesh | 66.0 | 69.2 |
| % − 200 Mesh | 10.8 | 7.7 |

The results indicate similar pulp strength properties in both the conditioned and compressed pulp example and the unpretreated sample. This similarity suggests that no damage to the wood fibers occurred in the compression step due presumably to the prior conditioning step of heat and pressure. It is expected that an increase in the conditioning temperature and retention time under pressure would further improve chemical pulp quality for a given application of digestion chemicals, or alternately reduce the chemical requirements for obtaining a given pulp quality.

What is claimed is:

1. A method for producing thermo-mechanical pulp in a primary disc refiner from lignocellulose fiber-containing chip feed material comprising the steps of:

first conditioning said fiber containing feed material while conveyed through a first chamber having an environment of saturated steam at an elevated pressure in the range of about 10–25 psig to produce conditioned feed material;

conveying and compressing the conditioned feed material through a second chamber having an environment of saturated steam at elevated pressure in the range of about 10–25 psig to produce a pretreated material having destructured fibers without significant breakage across grain boundaries;

preheating the pretreated material in a third chamber in an environment of saturated steam at a pressure above 75 psig and above the glass transition temperature of the lignin in the material, for a period of time less than 30 seconds;

conveying the pre-heated material to the inlet of a primary disc refiner operating at a pressure above 75 psig and a temperature above the glass transition temperature of the lignin; and refining the material at a disc speed of rotation that is greater than 1500 rpm for a double disc refiner or greater than 1800 rpm for a single disc refiner.

2. The method of claim 1, wherein the conditioning of said feed material is performed for a period of time in the range of 3–60 seconds.

3. The method of claim 2, wherein the preheat time period is in the range of about 5–10 seconds.

4. The method of claim 1, wherein the preheat time period is 15 seconds or less.

5. The method of claim 4, wherein the conditioning of said feed material is performed for a period of time in the range of 3–60 seconds.

6. The method of claim 1, wherein the step of preheating is preceded by the steps of discharging the destructed material into a conveyer at substantially atmospheric pressure;

conveying the discharged material into a storage bin at substantially atmospheric pressure; and conveying material from the bin by a plug screw feeder through a pressure barrier in to the higher pressure environment where said step of preheating is performed.

* * * * *